US007166399B2

(12) United States Patent
Carmichael et al.

(10) Patent No.: US 7,166,399 B2
(45) **Date of Patent: *Jan. 23, 2007**

(54) PHOTOSENSITIVE MEMBER HAVING ANTI-CURL BACKING LAYER WITH LIGNIN SULFONIC ACID DOPED POLYANILINE

(75) Inventors: Kathleen M. Carmichael, Williamson, NY (US); Robert C. U. Yu, Webster, NY (US); Richard L. Post, Penfield, NY (US); Anthony M. Horgan, Pittsford, NY (US); Satchidanand Mishra, Webster, NY (US); Edward F. Grabowski, Webster, NY (US); Satish R. Parikh, Rochester, NY (US); Donald J. Goodman, Pittsford, NY (US); David M. Skinner, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 253 days.

This patent is subject to a terminal disclaimer.

(21) Appl. No.: 10/825,450

(22) Filed: Apr. 14, 2004

(65) Prior Publication Data

US 2005/0233230 A1 Oct. 20, 2005

(51) Int. Cl.
*G03G 5/10* (2006.01)

(52) U.S. Cl. ..... 430/69; 430/56; 430/930; 428/195.1; 399/159

(58) Field of Classification Search ..... 430/69, 430/56, 930; 399/159, 162
See application file for complete search history.

(56) References Cited

U.S. PATENT DOCUMENTS 4,664,995 A 5/1987 Horgan et al.
5,021,309 A * 6/1991 Yu ..... 430/59.6
5,382,486 A 1/1995 Yu et al. ..... 430/56
5,686,214 A 11/1997 Yu
5,737,669 A * 4/1998 Ring ..... 399/130
5,968,417 A 10/1999 Viswanathan ..... 252/500
6,071,662 A 6/2000 Carmichael et al. ..... 430/69
6,132,923 A 10/2000 Maty et al. ..... 430/129
6,303,254 B1 10/2001 Yu et al. ..... 430/56
6,764,617 B1 * 7/2004 Viswanathan et al. ..... 252/500
6,932,921 B1 * 8/2005 Service ..... 252/500

OTHER PUBLICATIONS

Diamond, A.S., ed., *Handbook of Imaging Materials*, Marcel Dekker, Inc., NY (1991), pp. 395-396.*
U.S. Appl. No. 60/438,171, filed Jan. 6, 2003.*

* cited by examiner

*Primary Examiner*—Janis L. Dote
(74) *Attorney, Agent, or Firm*—Annette Bade

(57) ABSTRACT

An electrostatographic imaging member having a charge-retentive surface and a substrate, an imaging layer to receive an electrostatic latent image thereon, wherein the imaging layer is positioned on one side of the substrate, and an anti-curl backing layer positioned on the substrate on a side opposite to that of the imaging layer, wherein the anti-curl backing layer has a polymer binder and lignin sulfonic acid doped polyaniline, and an image forming apparatus having the above imaging member or photoreceptor to receive an electrostatic latent image on a charge-retentive surface of the photoreceptor or imaging member; a development component to apply toner to the charge-retentive surface to develop the electrostatic latent image to form a developed image on the charge-retentive surface; a transfer member to transfer the developed image from the charge-retentive surface to a copy substrate; and a fixing component to fuse the developed image to the copy substrate.

19 Claims, 4 Drawing Sheets

PHOTOSENSITIVE MEMBER HAVING ANTI-CURL BACKING LAYER WITH LIGNIN SULFONIC ACID DOPED POLYANILINE

CROSS REFERENCE TO RELATED APPLICATIONS

Reference is made to commonly-assigned, co-pending U.S. Patent Application Ser. No. 10/824,794, filed Apr. 14, 2004, (A2533Q-US-NP) entitled, "Photosensitive Member Having Ground Strip with Lignin Sulfonic Acid Doped Polyaniline," and U.S. patent application Ser. No. 10/825,453, filed Apr. 14, 2004, (A1391-US-NP) entitled, "Intermediate Transfer Members with Lignin Sulfonic Acid Doped Polyaniline." The disclosures of these commonly assigned applications being hereby incorporated by reference in their entirety.

BACKGROUND

Herein are described flexible electrostatographic imaging members including electrophotographic imaging members, such as photosensitive members, or photoconductors, or photoreceptors, and ionographic imaging members useful in electrostatographic apparatuses which, for example, include printers, copiers, other reproductive devices, and digital apparatuses.

Since typical flexible electrostatographic imaging members do exhibit upward curling after application of the top layer, an anti-curl back coating is required, in embodiments, to be coated at the back side of the members to render flatness. Flexible imaging members may include seamed or seamless belts or sheets in scroll form or belts mounted over a rigid drum (a drelt). Under electrostatographic imaging function conditions, a flexible imaging member belt dynamically cycling over a belt support module has been seen to encounter a gradual increase in belt drive torque caused by static built-up in the anti-curl back coating as a result of its mechanical interaction against the belt module support rollers and backer bars. Static built-up can exacerbate anti-curl back coating wear, which can create debris and dusty machine cavities. This, in turn, leads to contamination of copy printouts, and can also cause the imaging member belt to exhibit upward curling due to its thickness reduction. The final result is an anti-curl balancing result. Exhibition of imaging member upward curling affects surface charging uniformity, and thereby impacts copy printout quality. Moreover, excessive static built-up in the anti-curl coating during dynamic imaging member belt function has also caused the belt to stop rotating.

In an attempt to suppress or eliminate the static built-up problem, specific embodiments described herein include flexible photosensitive members comprising an anti-curl back coating having a conductive filler dispersed in a binder. In embodiments, the binder of the anti-curl back coating is a polymer and the conductive filler is lignin sulfonic acid doped polyaniline (Ligno-PANi). In embodiments, the undesirable characteristic of steep rise in conductivity of the anti-curl back coating, often time found to be associated with carbon black dispersion levels, can be avoided by using the Ligno-PANi filler. Process control, in embodiments, has thereby become more robust. In addition, in embodiments, build up of static charge during belt use in an electrostatographic imaging machine is reduced or eliminated. This, in turn, causes a reduction in anti-curl back coating wear, and thereby creates a debris and dust-free imaging member belt machine function condition. The notable drive torque is not increased, and belt stall is no longer an issue, in embodiments. Furthermore, reduction in anti-curl back coating wear maintains imaging member flatness for extended belt function assurance free of copy printout impact associated with the upward belt curling problem, in embodiments.

Flexible electrophotographic imaging members, including photoreceptors, photosensitive members, photoconductors, and the like, typically include a photoconductive layer formed on an electrically conductive flexible substrate or formed on layers between the flexible substrate and photoconductive layer. The imaging member does also include an anti-curl back coating applied to the back side of the flexible substrate to render imaging member flatness. The photoconductive layer is an insulator in the dark, so that electric charges are retained on its surface. Upon exposure to light, the charge is dissipated, and an image can be formed thereon, developed using a developer material, transferred to a copy receiving member, and fused thereto to form a copy or print.

The photoconductive layer may include a single layer or several layers. In embodiments wherein there are two layers, these two layers may include two electrically operative layers positioned on an electrically conductive layer with a photoconductive layer sandwiched between a contiguous charge transport layer and the conductive layer. The outer surface of the charge transport layer is normally charged in the dark with a uniform negative electrostatic charge, and the conductive layer is used as an electrode.

Since one or more layers are applied by, for example, solution coating to a flexible supporting substrate and each then subsequently dried at elevated temperatures, it has been found that the resulting photoconductive member tends to curl. This is due to the difference in thermal contraction of the substrate and the photoconductive layers, and also is due to the specific nature of the polymers used for each layer. Curling is undesirable for several reasons, including the fact that different segments of the imaging surface of the photoconductive member are located at different distances from charging devices, developer applicators, and the like, during the electrophotographic imaging process. Undesirably imaging member curling also prevents the receiving paper from making intimate contact with the imaging member surface for effectual toner image transfer. The result is that the quality of the ultimate developed images are adversely affected. For example, non-uniform charging distances can be manifested as variations in high background deposits during development of electrostatic latent images.

Coating may be applied to the back side of the supporting substrate opposite the photoconductive layer to counteract the tendency to curl. However, difficulties have been encountered with these anti-curl coatings. Anti-curl back coating will occasionally delaminate under normal function conditions of image belt cycling in copiers, duplicators, printers and facsimile machines. Anti-curl back coating delamination is caused by adhesion bond failure due to its excessive mechanical and frictional interactions against the components of the belt support module. Delamination is particularly troublesome in high-speed automatic copiers, duplicators and printers, which require extended cycling of the photoreceptor belt. Occurrence of delamination is very frequent under dynamic imaging member belt cycling conditions when severe static charge is built-up in the anti-curl back coating. Moreover, delamination is accelerated when the belts are cycled around small diameter rollers and rods.

Since the anti-curl back coating is an outermost exposed layer, it has further been found that during cycling of the photoconductive imaging member in electrophotographic imaging systems, the relatively rapid wearing away of the anti-curl coating also results in the curling of the photoconductive imaging member due to thickness reduction by wear. In some tests, the anti-curl back coating was completely worn off in about 150,000 to about 200,000 belt cycles. This erosion problem of anti-curl back coating is even more pronounced when photoconductive imaging members in the form of webs or belts are supported in part by stationary guide surfaces, e.g. backer bars. The anti-curl layer may wear away very rapidly and produce debris, which scatters and deposits on critical machine components such as lenses, corona charging devices, and the like. This, in turn, adversely affects machine performance. Moreover, the debris from bisphenol A type polycarbonate anti-curl backing layers tends to deposit on backer bars and other support members. These deposits result in a loud high pitched humming sound emitted during image cycling.

It has also been observed that when conventional belt photoreceptors using a bisphenol A polycarbonate anti-curl backing layer are extensively cycled in precision electrostatographic imaging machines, undesirable defect print marks were formed on copies.

It has been found that certain polycarbonate film forming polymer binders containing a monomeric unit derived from 1,1-bis(4-hydroxyphenyl)-3,3,5-trimethylcyclohexane reduced or eliminated the above problems. In addition, inorganic metal oxides and silica fillers or organic PTFE and lubricant stearate fillers incorporated into the material matrix of anti-curl back coating, have also been proven to be effective in imparting wear resistance enhancement.

However, there still remains a problem in that the photoreceptor belt can build up static charge on the insulating anti-curl backing coating (ACBC) of the belt as it is moved over the rollers. Static built-up can cause several of problems. In the film industry, the resistivity range of from about $10^{-6}$ to about $10^{-14}$ ohms/sq, or from about $10^{8}$ to about $10^{13}$ ohms/sq, is referred to as the static dissipative range, which means not resistive enough to build up static charge, but not really conductive. It is desired to be able to modify the resistivity of the coating into this desired range. It is further desired to prevent build up of debris and dusty machine cavities, which, in turn, can lead to contamination of copy printouts, can cause the imaging member belt to exhibit upward curling due to its thickness reduction, and can result in an imbalance, and finally, to belt stall. It is further desired to prevent the belt from premature cracking.

SUMMARY

Embodiments include an electrostatographic imaging member comprising a flexible supporting substrate, an anti-curl back layer positioned on one side of the substrate, and an imaging layer positioned on the substrate on a side opposite the anti-curl back layer, wherein the anti-curl back layer comprises a film forming polymer binder and a lignin sulfonic acid doped polyaniline dispersion.

Embodiments further include an image forming apparatus for forming images on a recording medium comprising a photoreceptor comprising a charge-retentive surface, the photoreceptor comprising a substrate, an imaging layer to receive an electrostatic latent image thereon, wherein the imaging layer is positioned on one side of the substrate, and an anti-curl back layer positioned on the substrate on a side opposite to that of the imaging layer, wherein the anti-curl back layer comprises a film forming polymer binder and a lignin sulfonic acid doped polyaniline dispersion; a development component to apply toner to the charge-retentive surface to develop the electrostatic latent image to form a developed image on the charge retentive surface; a transfer belt to transfer the developed image from the charge retentive surface to a copy substrate; and a fixing component to fuse the developed image to the copy substrate.

Embodiments also include an image forming apparatus for forming images on a recording medium comprising a photoreceptor having a charge-retentive surface, the photoreceptor comprising a substrate, an imaging layer to receive an electrostatic latent image thereon, and at least one layer other than the imaging layer, wherein the at least one layer comprises a film forming polymer binder and a lignin sulfonic acid doped polyaniline dispersion; a development component to apply toner to the charge-retentive surface to develop the electrostatic latent image to form a developed image on the charge retentive surface; a transfer member to transfer the developed image from the charge retentive surface to a copy substrate; and a fixing component to fuse the developed image to the copy substrate.

BRIEF DESCRIPTION OF THE DRAWINGS

For a better understanding, reference may be made to the accompanying figures.

DETAILED DESCRIPTION

Figure 1:
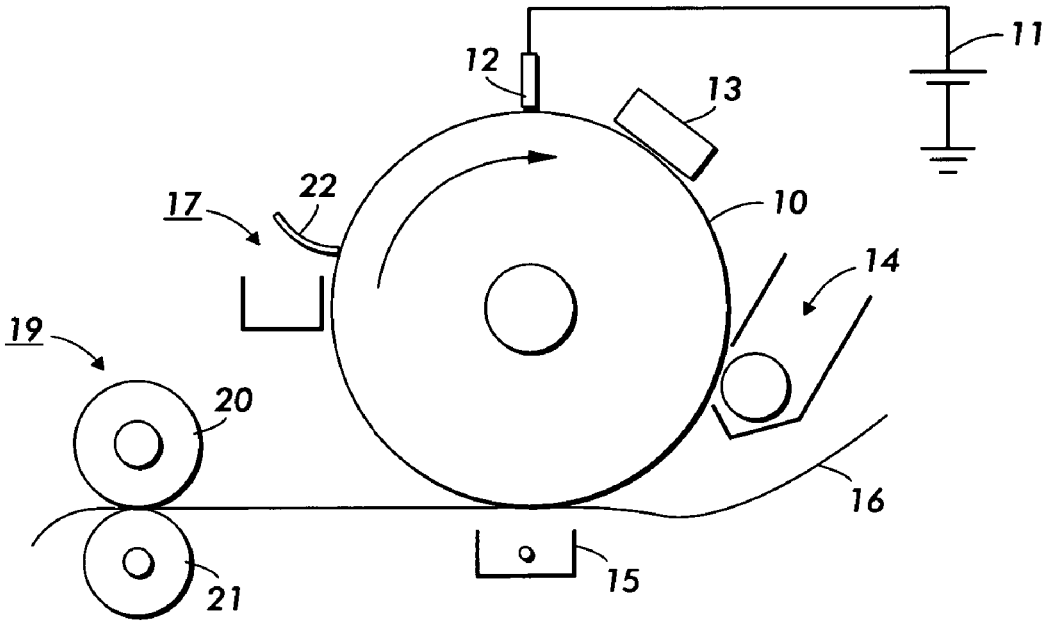
FIG. 1 is an illustration of a general electrostatographic apparatus using a photoreceptor member.

Referring to FIG. 1, in a typical electrophotographic reproducing apparatus, a light image of an original to be copied is recorded in the form of an electrostatic latent image upon a photosensitive member and the latent image is subsequently rendered visible by the application of electroscopic thermoplastic resin particles, which are commonly referred to as toner, to form a developed toner image for eventual transferring and permanent fusing onto a copy receiving member or copy substrate. Specifically, a photosensitive system, comprising a flexible photoreceptor belt mounted over a rigid drum to form a drelt photoreceptor 10, (a drelt is a cross between a drum and a belt, and is a belt formed over a drum) is charged on its surface by means of an electrical charger 12 to which a voltage has been supplied from power supply 11. The photoreceptor belt 10 is then imagewise exposed to light from an optical system or an image input apparatus 13, such as a laser and light emitting diode, to form an electrostatic latent image thereon. Generally, the electrostatic latent image is developed by bringing a developer mixture from developer station 14 into contact therewith. Development can be effected by use of a magnetic brush, powder cloud, or other known development process.

After the toner particles have been deposited on the photoconductive surface of flexible photoreceptor belt 10, in toner image configuration, they are transferred to a copy receiving sheet 16 by transfer means 15, which can be by either pressure transfer or electrostatic transfer mechanism. In embodiments, the developed toner image can alternatively be transferred to an intermediate transfer member and then subsequently transferred to a copy receiving sheet.

After the transfer of the developed toner image is completed, copy receiving sheet 16 advances to fusing station 19, depicted in FIG. 1, as fusing and pressure rolls, wherein the developed toner image is fused to the copy receiving sheet 16 by passing the copy sheet 16 between the fusing member 20 and pressure member 21, thereby forming a permanent image in copy printout. Fusing may otherwise be accomplished by other fusing means such as a fusing belt in pressure contact with a pressure roller, fusing roller in contact with a pressure belt, or other like systems. Photoreceptor belt 10, subsequent to transfer, advances to cleaning station 17, wherein any toner left on photoreceptor 10 is cleaned therefrom by use of a blade 22 (as shown in FIG. 1), brush, or other cleaning apparatus.

Figure 2:
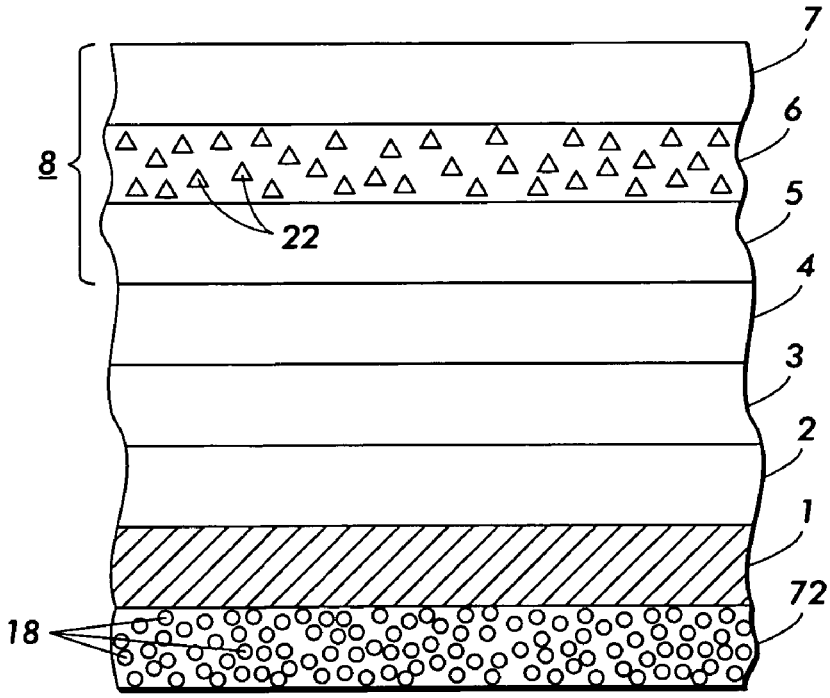
FIG. 2 is an illustration of an embodiment of a flexible photoreceptor belt showing various layers.

Electrophotographic imaging members are well known in the art. Electrophotographic imaging members in the form of a flexible photoreceptor belt may be prepared by any suitable technique. Referring to FIG. 2, typically, a flexible substrate 1 is provided with an electrically conductive surface or coating 2.

The flexible substrate 1 may be opaque or substantially transparent and may comprise any suitable material having the required mechanical properties. Accordingly, the flexible substrate may comprise a layer of an electrically non-conductive or conductive material such as an inorganic or an organic composition. As electrically non-conducting materials, there may be employed various resins known for this purpose including polyesters, polycarbonates, polyamides, polyurethanes, and the like which are flexible as thin webs. An electrically conducting substrate may be any flexible thin metal sheet, for example, aluminum, nickel, steel, copper, and the like or a polymeric material, as described above, filled with an electrically conducting substance, such as carbon black, metallic powder, and the like or an organic electrically conducting material. The electrically insulating or conductive flexible substrate may be in the form of an endless flexible belt, a web, a sheet, a scroll, a cylinder, and the like. The thickness of the substrate layer depends on numerous factors, including strength desired and economical considerations. Thus, for a flexible substrate, the thickness can be of less than a millimeter. Nonetheless, a flexible substrate may be of substantial thickness, for example, about 250 micrometers, or of minimum thickness of not less than 50.

In embodiments where the substrate layer 1 is not conductive, the surface thereof may be rendered electrically conductive by an electrically conductive coating 2. The conductive coating may vary in thickness over substantially wide ranges depending upon the optical transparency, degree of flexibility desired, and economic factors. Accordingly, for a flexible photoresponsive imaging device, the thickness of the conductive coating may be between about 20 angstroms to about 750 angstroms, or from about 100 angstroms to about 200 angstroms for an optimum combination of electrical conductivity, flexibility, and scratch resistance. The flexible conductive coating 2 may be an electrically conductive metal layer formed, for example, on the substrate by any suitable coating technique, such as a vacuum depositing technique, sputtering technique, or electrodeposition. Typical metals used include titanium, aluminum, zirconium, niobium, tantalum, vanadium and hafnium, gold, silver, nickel, stainless steel, chromium, tungsten, molybdenum, and the like.

For a negatively charged electrophotographic imaging member, an optional hole blocking layer 3 may be applied to the substrate or coating 2. Any suitable and conventional blocking layer capable of forming an electronic barrier to prevent injection of holes between from the conductive coating layer 2 of substrate 1 into the adjacent photoconductive layer 8 (or electrophotographic imaging layer 8) during electrophotographic imaging processes. Typical hole blocking layers include amino containing silanes, gelatin, hydroxy propyl cellulose, titanates, zirconates, and the like.

An optional adhesive layer 4 may be applied to the hole-blocking layer 3. Any suitable adhesive layer well known in the art may be used. Typical adhesive layer materials include, for example, film forming copolyesters, thermoplastic polyurethanes, polyarylates, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the hole blocking layer include spraying, dip coating, roll coating, wire wound rod coating, gravure coating, Bird applicator coating, and the like. Drying of the deposited coating may be effected by any suitable conventional technique such as oven drying, infrared radiation drying, air drying and the like.

At least one electrophotographic imaging layer 8, in reference to FIG. 2, is formed on the adhesive layer 4, blocking layer 3, conductive layer 2 or substrate 1. The electrophotographic imaging layer 8 may be a single layer that performs both charge generating and charge transport functions as is well known in the art, or it may comprise multiple layers such as a charge generator layer 5 and charge transport layer 6. It may further comprise an optional overcoat layer 7 to provide abrasion protection.

The charge generating layer 5 can be applied directly to the electrically conductive surface 2, or on other surfaces in between the substrate 1 and charge generating layer 5. To achieve best photo-electrical functioning result, a charge blocking layer or hole-blocking layer 3 may optionally be applied to the electrically conductive surface 2 prior to the application of a charge generating layer 5. Usually, the charge generation layer 5 is applied directly onto the blocking layer 3 and a charge transport layer 6, is formed on the charge generation layer 5. If desired, an adhesive layer 4 may be used between the charge blocking or hole-blocking layer 3 and the charge generating layer 5 to enhance adhesion linkage of these two layers.

However, for use in a positively charged apparatus, this imaging member structure may have the charge generation layer 5 on top of the charge transport layer 6 and in combination with the use of an electron blocking layer.

Charge generator layers may comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The charge generator layers may also comprise inorganic pigments of crystalline selenium and its alloys; Group II–VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques.

Phthalocyanines have been employed as photogenerating materials for use in laser printers using infrared exposure systems. Infrared sensitivity is required for photoreceptors exposed to low-cost semiconductor laser diode light exposure devices. The absorption spectrum and photosensitivity of the phthalocyanines depend on the central metal atom of the compound. Many metal phthalocyanines have been reported and include, oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal-free phthalocyanine. The phthalocyanines exist in many crystal forms, and have a strong influence on photogeneration.

Any suitable polymeric film forming binder material may be employed as the matrix in the charge generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrenebutadiene copolymers, vinylidenechloride-vinylchloride copolymers, vinylacetate-vinylidenechloride copolymers, styrene-alkyd resins, polyvinylcarbazole, and the like. These polymers may be block, random, or alternating copolymers.

The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder, or from about 20 percent by volume to about 30 percent by volume of the photogenerating pigment is dispersed in about 70 percent by volume to about 80 percent by volume of the resinous binder composition. In one embodiment, about 8 percent by volume of the photogenerating pigment is dispersed in about 92 percent by volume of the resinous binder composition. The photogenerator layers can also fabricated by vacuum sublimation in which case there is no binder.

Any suitable and conventional technique may be used to mix and thereafter apply the photogenerating layer coating mixture. Typical application techniques include spraying, dip coating, roll coating, wire wound rod coating, vacuum sublimation, and the like. For some applications, the generator layer may be fabricated in a dot or line pattern. Removing of the solvent of a solvent coated layer may be effected by any suitable conventional technique such as oven drying, infrared radiation drying, air drying and the like.

The charge transport layer 6 may comprise a charge transporting small molecule 22 dissolved or molecularly dispersed in a film forming electrically inert polymer such as a polycarbonate. The term "dissolved" as employed herein is defined herein as forming a solution in which the small molecule is dissolved in the polymer to form a homogeneous phase. The expression "molecularly dispersed" is used herein is defined as a charge transporting small molecule dispersed in the polymer, the small molecules being dispersed in the polymer on a molecular scale. Any suitable charge transporting or electrically active small molecule may be employed in the charge transport layer. The expression charge transporting "small molecule" is defined herein as a monomer that allows the free charge photogenerated in the photogenerating layer to be transported across the charge transport layer. Typical charge transporting small molecules include, for example, pyrazolines such as 1-phenyl-3-(4'-diethylamino styryl)-5-(4"-diethylamino phenyl)pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl)carbazyl hydrazone and 4-diethyl amino benzaldehyde-1,2-diphenyl hydrazone, and oxadiazoles such as 2,5-bis (4-N,N'-diethylaminophenyl)-1,2,4-oxadiazole, stilbenes and the like. However, to avoid cycle-up in machines with high throughput, the charge transport layer 6 should be substantially free (less than about two percent) of di- or tri-amino-triphenyl methane. As indicated above, suitable electrically active small molecule charge transporting compounds are dissolved or molecularly dispersed in electrically inactive polymeric film forming materials. A small molecule charge transporting compound that permits injection of holes from the pigment into the charge generating layer with high efficiency and transports them across the charge transport layer with very short transit times is N,N'-diphenyl-N,N'-bis(3-methylphenyl)-(1,1'-biphenyl)-4,4'-diamine. If desired, the charge transport material in the charge transport layer 6 may comprise a polymeric charge transport material or a combination of a small molecule charge transport material and a polymeric charge transport material.

Typical inactive resin binder employed as charge transport layer 6 formulation includes polycarbonate resin, polystyrene, polyester, polyarylate, polyacrylate, polyether, polysulfone, and the like. Examples of binders include polycarbonates such as poly(4,4'-isopropylidene-diphenylene)carbonate (also referred to as bisphenol-A-polycarbonate, poly(4,4'-cyclohexylidinediphenylene) carbonate (referred to as bisphenol-Z polycarbonate), poly(4,4'-isopropylidene-3,3'-dimethyl-diphenyl)carbonate (also referred to as bisphenol-C-polycarbonate), and the like. Molecular weights can vary, for example, from about 20,000 to about 150,000. Any suitable charge transporting polymer may also be used in the charge transporting layer. The charge transporting polymer can be insoluble in the solvent employed to apply the overcoat layer 7. These electrically active charge transporting polymeric materials should be capable of supporting the injection of photogenerated holes from the charge generation material and be capable of allowing the transport of these holes therethrough.

Any suitable and conventional technique may be used to mix and thereafter apply the charge transport layer 6 coating mixture to the charge generating layer 5. Typical application techniques include extrusion coating, spraying, dip coating, roll coating, wire wound rod coating, and the like. Drying of the deposited coating may be effected by any suitable conventional technique such as oven drying, infrared radiation drying, air drying and the like.

Generally, the thickness of the charge transport layer 6 is between about 10 and about 80 micrometers, but thicknesses outside this range can also be used. The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer 6 to the charge generator layer 5 can be maintained from about 2:1 to 200:1 and in some instances as great as 400:1. The charge transport layer, is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

In embodiments, an optional overcoat 7 is coated on the charge transport layer 6. In embodiments, a polyamide resin is used as the resin in the overcoat layer 7. In embodiments, the polyamide is an alcohol-soluble polyamide (such as LUCKAMIDE®).

Since the imaging member will, at this point, spontaneously curl upwardly, an anti-curl back coating 72 can be included on the underside of the substrate 1 to render the imaging member its desired physical flatness. Typical anti-curl back coatings comprise a film forming thermoplastic polymer binder and an adhesion promoter dopant to impart adhesion bonding to the substrate. In the present invention, the formulation of anti-curl back coating 72 may include lignin sulfonic acid doped polyaniline (Ligno-PANi fillers) 18 dispersed or contained therein the material matrix of the coating. In addition, anti-curl back coating 72 may further comprise inorganic or organic particles dispersion, such as for example metal oxides, silica, PTFE, waxy polyethylene, stearates, and the like to impart wear and abrasion resistance.

Figure 3:
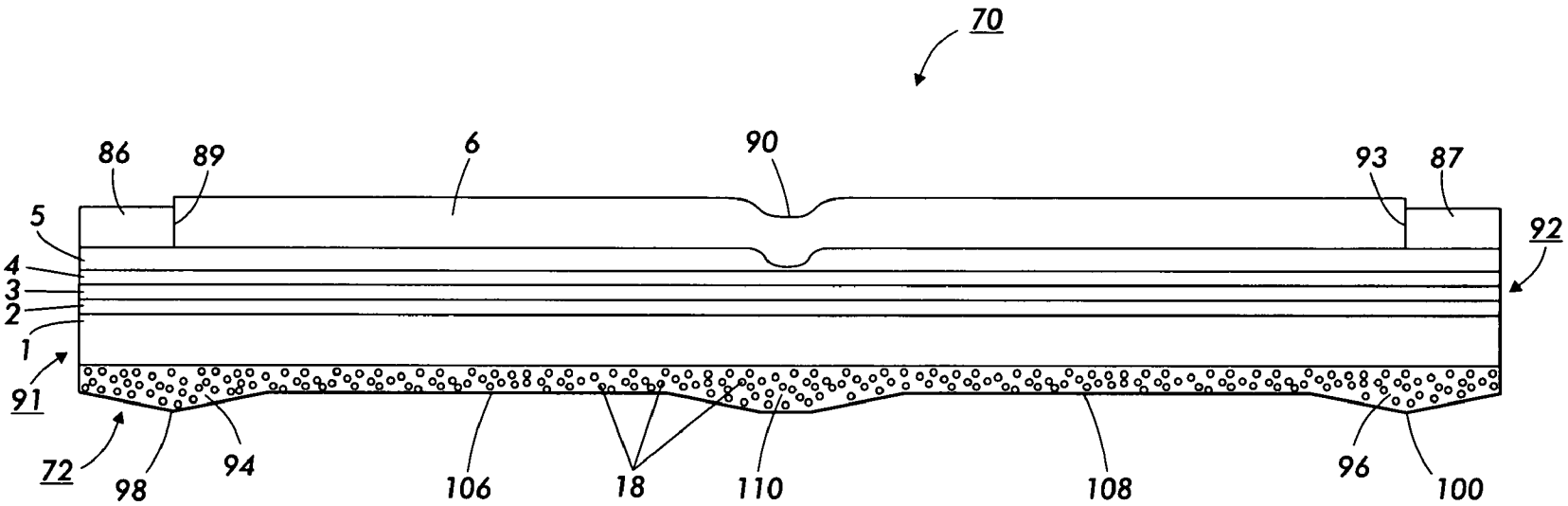
FIG. 3 is a cross sectional view in a direction along the length of a coated photoreceptor web.

According to the illustration in FIG. 3, a cross-sectional view in a direction along the length of a typical production, coated double wide, flexible photoreceptor web 70 (having the same structure and material compositions as those described in FIG. 2) is shown. All the layers in web 70 are conventional except the anti-curl backing layer 72 (also shown in FIG. 2). More specifically, web 70 comprises the formulation of anti-curl backing layer 72, a substrate layer 1, a conductive layer 2, a charge blocking layer 3, an adhesive layer 4, a charge generating layer 5, a charge transport layer 6, and ground strip layers 86 and 87 which form edge to edge contact junctions 89 and 93, respectively, with charge transport layer 6. Ground strips 86 and 87 have essentially identical material compositions. A narrow depression 90, running the length of the web 70, formed by the absence of a charge generating layer 5 material is maintained to facilitate lengthwise slitting of double wide photoreceptor web 70 and to prevent delamination of some of the coatings on the conductive layer 2 side of substrate layer 1. Since the charge generating layer 5 is very thin, e.g., about 1 micrometer, the absence of charge generating layer material in the region of narrow depression 90 underlying is virtually unnoticeable as a depression. However, it can be identified by color and reflectivity differences. Because photoreceptor web 70 has a narrow ground strip layer 86 along a first parallel side 91 of the web 70 adjacent to and in edge to edge contact with the charge transport layer 6, the edge to edge contact junction 89 extending parallel to the first parallel side 91, a first minor edge region 94 in anticurl back coating 72 is positioned under the narrow ground strip 86 and has a width extending from substantially the first parallel side 91 past the edge to edge contact junction 89 and under a narrow region of the charge transport layer. Similarly, since double wide web 70 has another narrow ground strip layer 87 along a second parallel side 92 adjacent to and in edge to edge contact with the charge transport layer 6, the edge to edge contact junction 93 extending parallel to the second parallel side 92, a second minor edge region 96 in anti-curl backing layer 72 is positioned under the narrow ground strip 87 and has a width extending from substantially the second parallel side 92 past the edge to edge contact junction 93 and under a narrow region of the charge transport layer 6. The first minor edge region 94 and second minor edge region 96 may have a thickness peak 98 and 100, respectively, substantially directly under and aligned with edge to edge contact junction 89 and edge to edge contact junction 93, respectively. The thickness of a cross-section of first minor edge region 94 gradually becomes thinner in a direction away from the thickness peak 98 and toward the first parallel side 91 and also becomes thinner in a direction away from the peak 98 toward the second parallel side 92 until the thickness of the first minor edge region 94 is substantially equal to the thickness of the major central region 106. Similarly, the thickness of a cross section of second minor edge region 96 gradually becomes thinner in a direction away from the thickness peak 100 and toward the second parallel side 92 and also becomes thinner in a direction away from the peak 100 toward the first parallel side 91 until the thickness of the second minor edge region 96 is substantially equal to the thickness of the major central region 108. The double wide minor region 110 in the middle of web 70 is, in essence, two back to back minor edge regions that form after web 70 is slit lengthwise along narrow uncoated strip 90. Thus, double wide minor region 110 underlies narrow uncoated strip 90 and part of the region coated with blocking layer 3, adhesive layer 4, charge generating layer 5 and charge transport layer 6. After slitting of photoreceptor web 70 through the middle of depression 90 to give two identical single wide photoreceptor webs, the shape of a cross section of each half of the double wide minor region 110 is substantially a mirror image of the part of minor edge region 94 or 96 on the opposite side of major central region 106 or 108, if minor edge region 94 or 96 were slit along thickness peak 98 or 100, respectively.

The thickness of anti-curl back coating 72 is varied in a specified way across the width of the imaging member sheet, web or belt to substantially balance the total upward curling forces of the layer or layers on the opposite side of the supporting substrate layer 1 and render flatness, even after extensive image cycling. Generally, the thickness of the major central region of an anti-curl back coating 72 has a substantially uniform thickness between about 5 to about 60 micrometers, or from about 10 to about 50 micrometers, but thickness outside this range can also be used. The major central region underlies the region where images are formed during an electrostatographic imaging process. The thicker minor edge regions of the anticurl back coating are located along each parallel side of the photoreceptor web and substantially underlie the regions where images are not formed during an electrostatographic imaging process. The minor edge regions of the anticurl backing layer each having a thickness greater than the thickness of the major central region. The additional thickness depends upon numerous factors, including the specific materials utilized in the imaging member above and below the supporting substrate, the thicknesses of the layers above and below the supporting substrate, the width of the imaging member, the width and shape of the minor edge region, and the like. A typical thickness range for the incremental increase of the thickest part of the minor edge region over the uniform thickness of the anti-curl back coating 72 in the major central region is between about 0.1 micrometer and about 5 micrometers. The width of the minor edge region is typically between about 5 millimeters and about 50 millimeters.

For a single wide imaging member, the first minor edge region and the second minor edge region each may have a width that is between about 1 percent and about 10 percent of the total width of the imaging member and the major central region may have a width that is between about 80 percent and about 98 percent of the total width of the imaging member or single wide photoreceptor web.

In a typical example, the regional increase in anti-curl back coating thickness (that is the added thickness of the thickest part of each minor edge region over the uniform thickness of the anti-curl back coating in the major central region of the single wide photoreceptor web) is between about 1 micrometer and about 3 micrometers. The width of each minor edge region is about 25.4 millimeters (1 inch) for an anti-curl back coating having a uniform thickness of about 20 micrometers (in the major central region) reduces and eliminates the edge curl problem of a prepared single photoreceptor web having a width of 50 centimeters.

The cross-sectional shape of the part of a minor edge region above an imaginary extension of the exposed surface of the major central region, when viewed in a direction parallel to the parallel side of the imaging member, may have any suitable shape. Typical shapes include, for example, triangular, rectangular, square, oval, rhombic, and the like. The exposed sides of these shapes may be straight or curved. For a minor edge region underlying only a charge transport layer, the shape is similar to a long thin right triangle with the second longest side of the triangle lying in contact with an imaginary extension of the exposed surface of the major central region of the anti-curl backing layer and with the hypotenuse angling away from the nearest parallel side of the imaging member and inclined toward the exposed surface of the major central region of the anticurl backing layer. The shortest side of this right triangle example would represent the thickest part of the minor edge region over the uniform thickness of the anticurl backing layer in the major central region. Where the minor edge region underlies a ground strip layer in edge-to-edge contact with a charge transport layer, the cross-sectional shape of the minor edge region may be similar to that of two back-to-back long thin right triangles with the apex of the two longest sides of one of the triangles located at the nearest parallel side of the imaging member and the apex of the two longest sides of the other of the triangles located at the border between the minor edge region and the major central region. Thus, an embodiment of a cross-sectional shape for a minor edge region is one which has (1) the greatest thickness at a parallel side or (2) the greatest thickness below a junction of a ground strip layer in edge-to-edge contact with a charge transport layer.

Each of the ground strip layers 86 and 87, coated adjacent to the charge transport layer 6, in the production photoreceptor web 70 is a highly electrical conductive layer. Under a machine function condition, the ground strip in a fabricated flexible photoreceptor belt is needed to serve as an effective linkage to the conductive layer 2 for electrical continuity during electrophotographic imaging process.

The photoreceptor may be in the form of a belt structure consisting of a belt mounted over a rigid drum (drelt), sheet, web, scroll, or other suitable form. In the case of a belt, the belt may include a seam or be seamless. However, a photoreceptor in a sheet, web, or scroll configuration, can be an unseamed imaging member. In the case of a flexible seamed photoreceptor belt, the belt seam may be formed by using ultrasonic welding, gluing, stapling, heat fusing, or the like process. Although the fabrication of a seamed photoreceptor belt may include a technique of creating interlocking seaming members, such as puzzle cut seam, nevertheless ultrasonic seam welding process to form an overlap joint is based from the simplicity of operation procedure, processing time required, and the resulting seam rupture strength considerations. Examples of interlocking seams, such as puzzle-cut seams, and processes for making such seems can be found in commonly-assigned U.S. Pat. No. 6,379,486, the disclosure of which is hereby incorporated by reference in its entirety.

Figure 4:
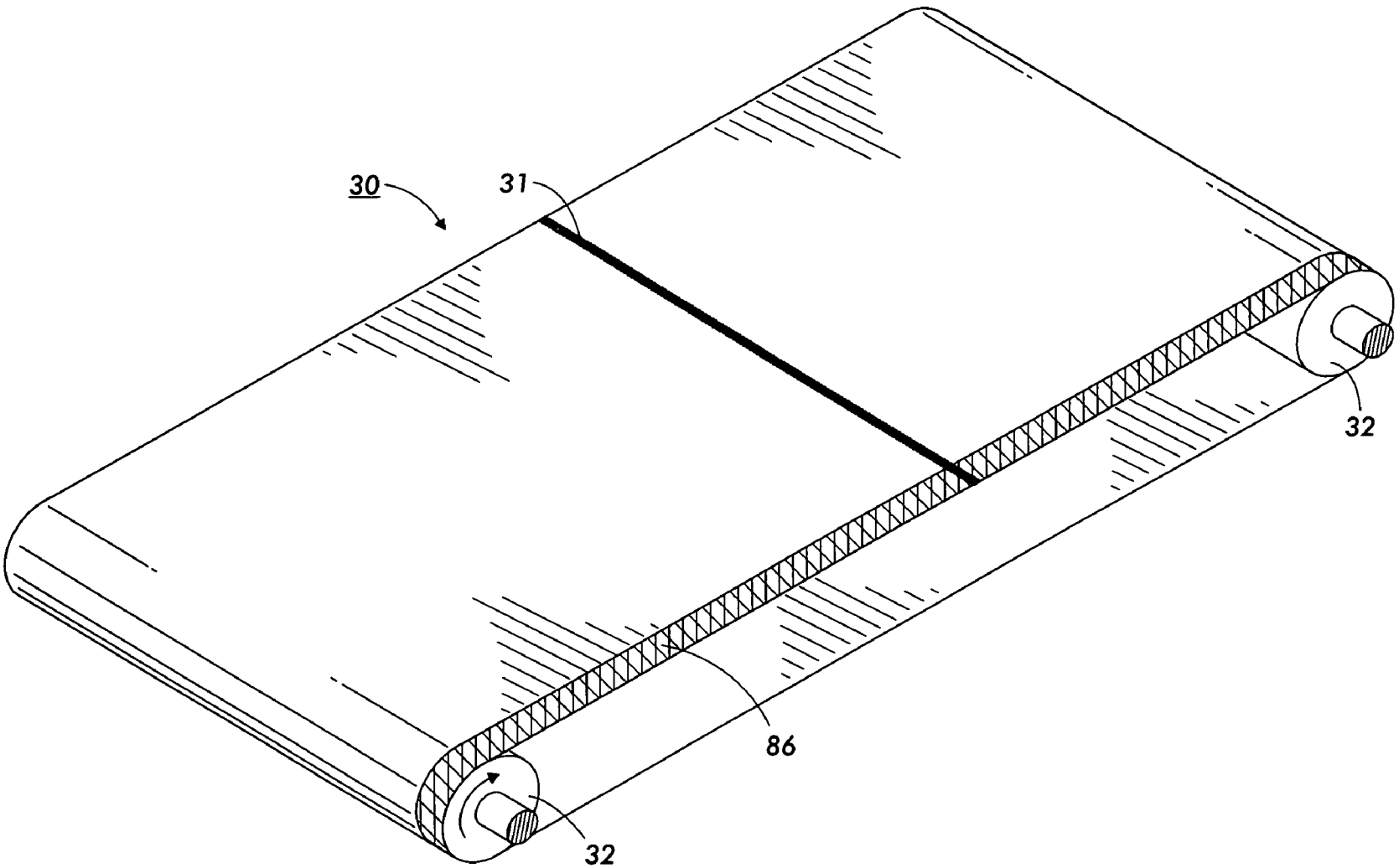
FIG. 4 is an enhanced view of an embodiment of a welded belt configuration.

FIG. 4 illustrates an example of an embodiment of a flexible seamed photoreceptor belt having an anti-curl back coating formulation. Belt 30, with a seam 31 and a conductive ground strip layer 86, is shown mounted over and encircling a bi-roller belt support module comprising two rotating rollers 32 in which one roller is a driving roller to turn and rotate the belt while the other is functioning as a free rotation idle roller. Seam 31 is pictured as an example of one embodiment of having an ultrasonically welded seam. The flexible belt is held in position and turned by the drive and idle rollers 32. The belt support module carrying the flexible photoreceptor belt can be used for direct replacement of drelt photoreceptor 10 in the electrophotographic imaging apparatus shown in FIG. 1.

Referring to FIG. 3 again, note that the anti-curl back coating, situated at the back side and being the outermost layer of the belt, is in constant dynamic frictional contact with these rollers during machine belt cycling function. The physical and frictional interaction of the ant-curl back coating against the belt support rollers is seen to cause static charge build-up in the back side of the belt to gradually increase the belt drive torque and has occasionally been found to reach a point that it does virtually stall the belt rotation. Moreover, belt drive torque increase exacerbates anti-curl back coating wear. This causes debris and dust to generate inside the machine. It further cases the belt edges to curl upward as a result of anti-curl back coating thickness reduction by material loss to wear. Photoreceptor belt upward curling affects surface charging uniformity, which has then been seen to manifest into copy print out defects. A flexible photoreceptor belt having a conductive anti-curl back coating formulation comprising lignin sulfonic acid dope polyaniline (Ligno-PANi) particles dispersion in its material matrix, has been created and demonstrated to effect static charging suppression, and in embodiments, thereby eliminating the photoreceptor belt stall problem altogether.

The flexible photoreceptor belt herein includes a substrate and at least one layer. In embodiments, the photoreceptor includes a substrate, an imaging layer, and an anti-curl back coating. The imaging layer may include the charge transport layer, charge generating layer, conductive layer, charge blocking layer, or the like. The anti-curl backing layer is on a side of the substrate opposite the imaging layer.

In embodiments, an anti-curl back coating is applied to the rear side, or side opposite the imaging layer, of the substrate in order to improve flatness. Detailed examples of embodiments of anti-curl backing layers can be found in commonly assigned U.S. Pat. No. 6,123,923, the subject matter of which is hereby incorporated by reference in its entirety.

In embodiments, the anti-curl back coating comprises a binder having Ligno-PANi fillers dispersed therein. In other embodiments, anti-curl back coating comprises a binder, an adhesion promoter, and Ligno-PANi fillers.

The anti-curl back coating includes a binder, an optional adhesion promoter, and Ligno-PANi dispersion. The binder can be a robust film forming polymer having sufficient mechanical strength to be suitable for use in an electrostatographic machine, and must be capable of sustaining dynamic function requiring a large number of belt revolutions and numerous mechanical flexes around the belt module support rollers. Suitable polymers for use in the anti-curl back coating include polycarbonates, polystyrenes, polyesters, polyamides, polyurethanes, polyarylethers, polysulfones (such as polyarylsulfones, polyethersulfones, and the like), polyarylate, polybutadienes, polyalkylenes (such as polypropylenes, polyethylenes, and the like), polyimides (such as polyamide imide), polymethylpentenes, polyphenylene sulfides, polyvinyl acetate, polysiloxanes, polyacrylates, polyvinyl acetals, polyamides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride vinylchloride copolymers, vinylacetate-vinylidenechloride copolymers, styrene-alkyd resins, and the like, and mixtures thereof. These polymers may be block, random or alternating copolymers. In addition, other polymers may also include polyvinylcarbazole, polyester, polyarylate, polyacrylate, polyether, polysulfone, polystyrene, and the like. Molecular weights can vary from about 20,000 to about 150,000.

In embodiments, the binder is a polycarbonate, a thermoplastic polymer, which has desired physical, mechanical, and thermal properties. The polycarbonate may be a bisphenol A polycarbonate material such as poly(4,4'-isopropylidene-diphenylene carbonate) having a molecular weight of from about 35,000 to about 40,000, available as Lexan 145 from General Electric Company and poly(4,4'-isopropylidene-diphenylene carbonate) having a molecular weight of from about 40,000 to about 45,000, available as Lexan 141 also from the General Electric Company. A bisphenol A polycarbonate resin having a molecular weight of from about 50,000 to about 120,000 is available as MAKROLON from Farben Fabricken Bayer A. G. A lower molecular weight bisphenol A polycarbonate resin having a molecular weight of from about 20,000 to about 50,000 is available as MERLON from Mobay Chemical Company. Another type of polycarbonate of interest is poly(4,4-diphenyl-1,1'-cyclohexane carbonate), which is a film forming thermoplastic polymer structurally modified from bisphenol A polycarbonate. It is commercially available from Mitsubishi Chemicals. Another example of a polycarbonate binder is poly(4,4'-isopropylidene-3,3'-dimethyl-diphenyl carbonate). The binder may also be a mixture of polycarbonates.

An adhesion promoter such as, for example, copolyester MORESTER 49,000 (available form Morton Chemicals), VITEL copolyester (available for Goodyear Rubber and Tire Company), polyethylene terephthalate glycol (PETG) (available from Eastman Chemicals), and the like, and mixtures thereof, can be added to the Ligno-PANi dispersion containing polycarbonate binder to effect adhesion bonding enhancement of the invention anti-curl back coating 72 to the substrate 1. The adhesion promotor can be added in an amount of from about 1 to about 15 percent, or from about 6 to about 10 percent by weight of film forming binder, and not including Ligno-PANi.

The details of Ligno-PANi are described in literature, including U.S. Pat. No. 5,968,417, the disclosure thereof being herein incorporated by reference in its entirety. Ligno-PANi is a lignin sulfonic acid doped polyaniline which may be prepared in a laboratory by passing an aqueous solution of lignosulfonic acid, ethoxylated, sodium salt through a protonated Dowex-HCR-W2 cation ion exchange column to give lignin sulfonic acid, which is further reacted with aniline to produce anilinium lignosulfonate salt, and then finally oxidatively polymerized in the presence of ammonium persulfate to form a green colored powder of electrically conducting lignosulfonic acid doped polyaniline called Ligno-PANi.

Ligno-PANi is a lignin sulfonic acid doped polyaniline. In simple language, Ligno-PANi is conductive particles each comprising polyaniline chains grafted to sulfonated lignin. Lignin is a principal constituent of wood structure of higher plants. Lignin comprises structure from the polymerization of both coniferyl alcohol and sinapyl alcohol. Lignin may also comprise functional groups such as hydroxy, methyoxy, and carboxy groups. Lignosulfonates are sulfonated lignins or polyaryl-sulfoniac acids that are highly soluble in water. Lignosulfonates can be used as dispersants, binders, emulsion stabilizers, complexing agents, and other applications. The aryl rings of lignosulfonate polymers may comprise a variety of functional groups such as hydroxy, methoxy and carboxy groups that can be crosslinked after polymerization. Also, lignosulfonates comprise multiple sulfonic acid groups that can be used for doping polymers. Ligno-PANi is a redox active, highly dispersible, cross-linkable filler and can be incorporated into a wide range of binders. Ligno-PANi is available commercially from NASA. Sulfonated polyaryl compounds can be attached to linearly conjugated Tr-systemsby ionic or covalent bonds, as well as through electrostatic interactions such as hydrogen bonds. The molecular weight of Ligno-PANi may be from about 5,000 to about 200,000, or from about 10,000 to about 100,000, or from about 15,000 to about 50,000. Dispersed in a variety of polymers, Ligno-PANi can be either web-coated or extruded. The Ligno-PANi used for anti-curl back coating dispersion preparation has an average particle size of between about 1.9 and about 2.5 micrometer diameter when approximated as spherical in particle shape. However, smaller Ligno-PANi particle size below this range, if desired, can be obtained by using particle classification technique.

In embodiments, Ligno-PANi has the following general Formula I:

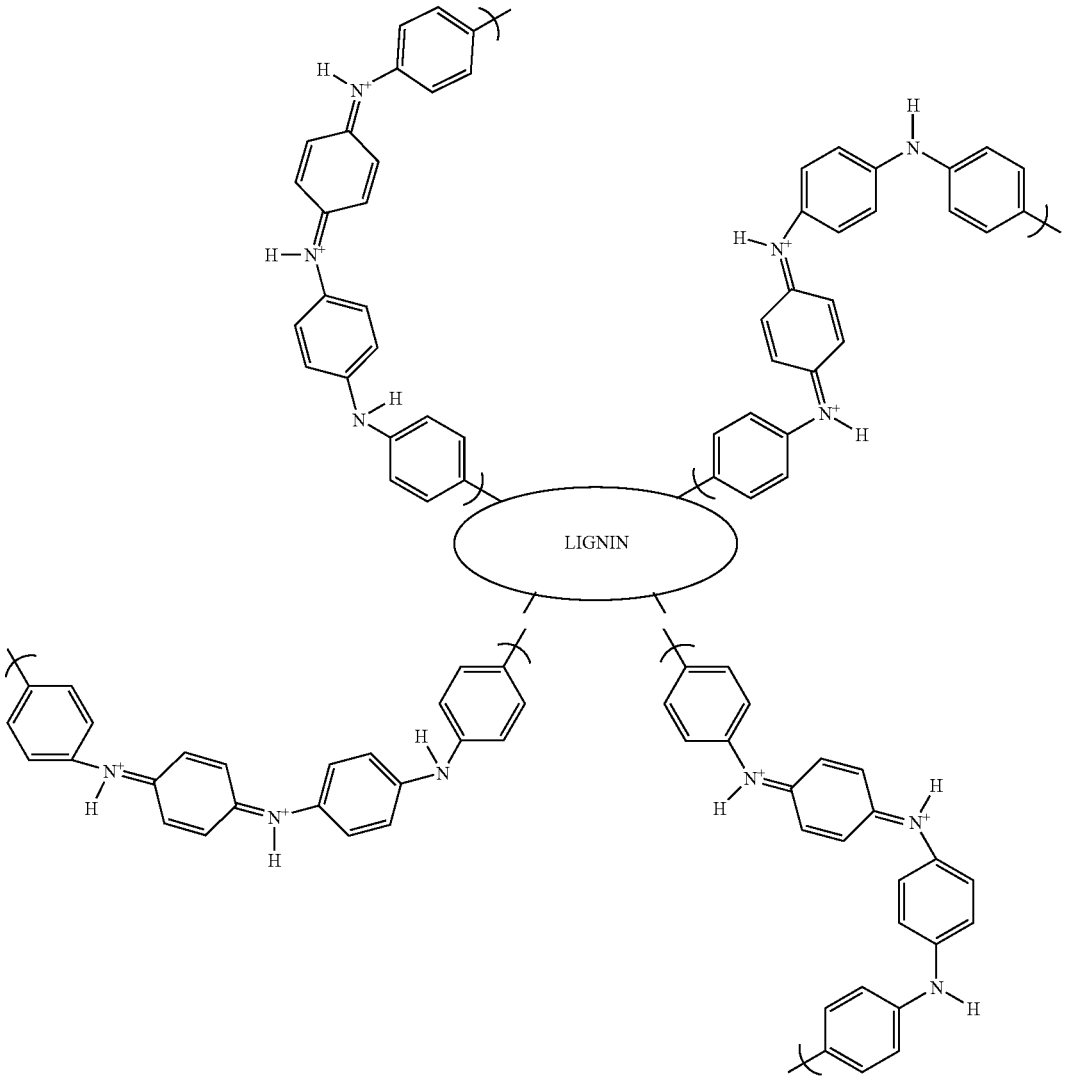

In other embodiments, the Ligno-PANi has the following Formula II:
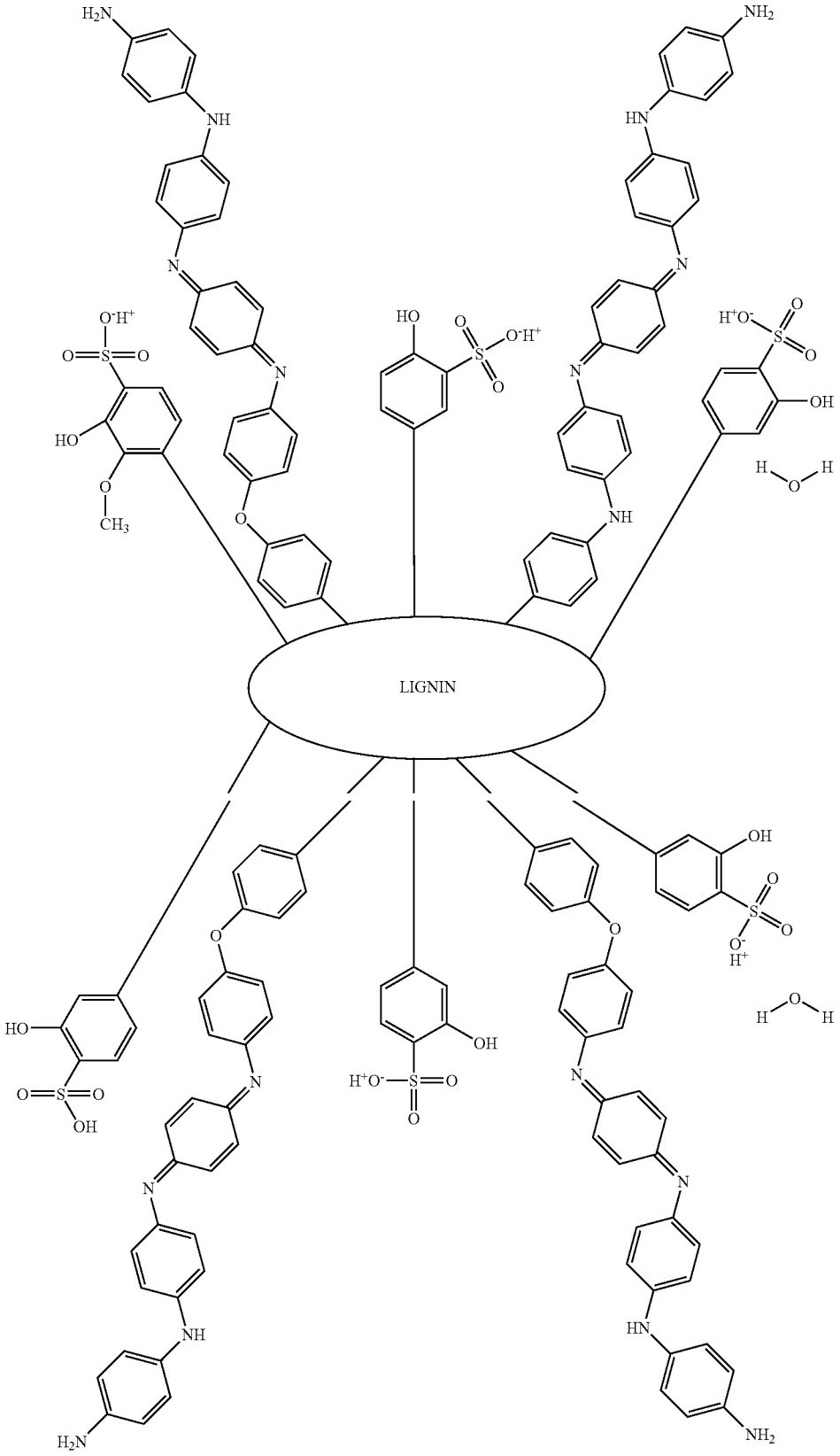

The surface resistivity of the anti-curl backing layer is from about $10^6$ to about $10^{14}$ ohms/sq, or from about $10^8$ to about $10^{13}$ ohms/sq.

Ligno-PANi is present in the binder of the anti-curl back coating of the photoreceptor belt in an amount of from about 1 to about 50, or from about 5 to about 20, or from about 6 to about 10 percent by weight of total solids. Total solids, as used herein, refers to the amount of solids (such as binders, adhesion promoters, fillers, Ligno-PANi, and other solids) present in anti-curl back coating of the photoreceptor belt.

A second filler or more than one second filler, in addition to Ligno-PANi, can be present in the anti-curl backing layer. Examples of suitable fillers include inorganic fillers (such as silica, silicates, and the like), metals, metal oxides, polymer fillers, doped metal oxides, carbon fillers, and the like, and mixtures thereof. Examples of suitable fillers include carbon fillers such as graphite, carbon black, fluorinated carbon such as ACCUFLUOR® or CARBOFLUOR® from Advance Research Chemicals, Caroosa, Okla., and like carbon fillers, and mixtures thereof. Other examples include inorganic fillers such as silica, silicates; metal oxide fillers such as copper oxide, iron oxide, magnesium oxide, aluminum oxide, zinc oxide, and the like, and mixtures thereof; doped metal oxide fillers such as antimony doped tin oxide (for example, ZELEC®), and the like, and mixtures thereof. Other examples include polymer fillers such as PTFE, stearates, polyalkylenes (such as waxy polyethylene, wax polypropylene, and the like), and the like, and mixtures thereof. Other fillers may be used, such as fillers having a purpose of altering the surface and mechanical properties. These include polytetrafluoroethylene powder, microcrystalline silica, and the like. A specific example of a filler is ZONYL® polytetrafluoroethylene powder available from DuPont or POLYMIST® powder available from Ausimont. Other examples include microcrystalline silica available from Malvern Minerals.

If present, the additional filler other than Ligno-PANi is present in the anti-curl back coating in an amount of from about 1 to about 10, or from about 2 to about 5.

Without the addition of Ligno-PANi, the static charge which builds up on the anti-curl backing layer will increase the belt drag and frictional force on a cycling motion belt leading to premature anti-curl back coating wear problem, exhibition of belt upward curling, belt drive torque increase, and finally total belt motion stalling. On the other hand, the static charge in the anti-curl back coating is bled away by incorporation of Ligno-PANi dispersion to resolve these issues, and the life of the belt is prolonged and extended by use of embodiments herein. It is an advantage to be able to modify the resistivity of the anti-curl backing layer to a desired range. The addition of Ligno-PANi dispersion to the anti-curl backing layer allows the resistivity of the anti-curl backing layer to be dissipated and adjusted into the desired troublesome free static charge range.

Figure 5:
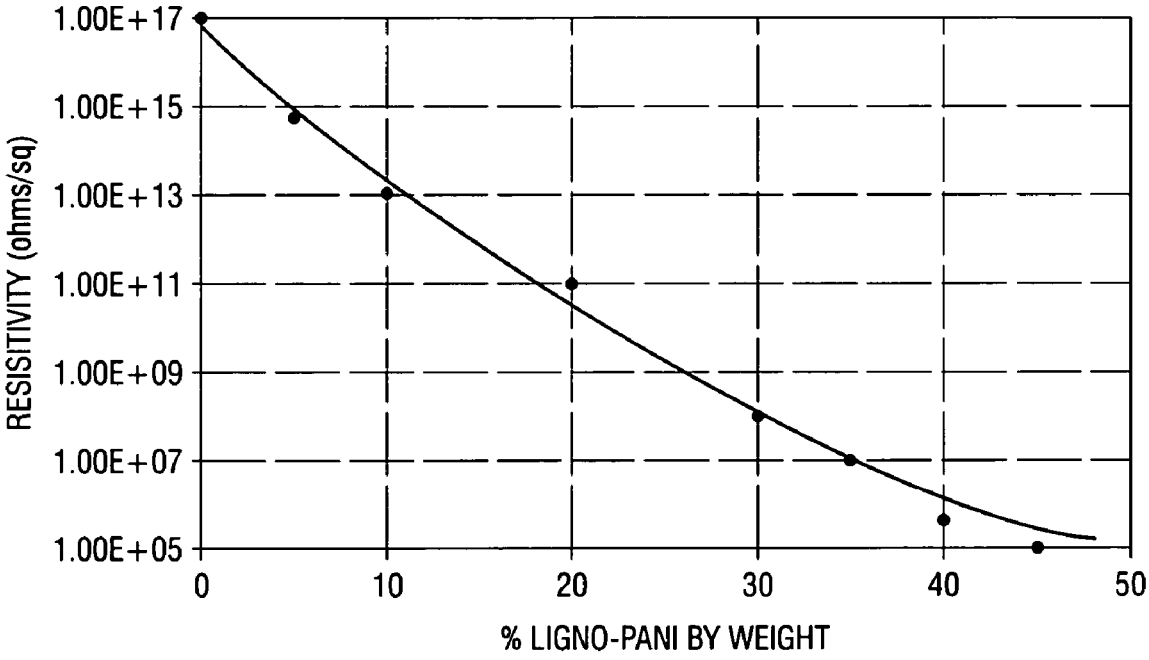
FIG. 5 is a graph showing resistivity in ohms/sq versus Ligno-PANi loadings in percent by weight of total solids.

As shown in the graph of FIG. 5, Ligno-PANi dispersion in an anti-curl back coating, in all these loading level variances, is effectual to provide electrical conductivity and give desirable anti-static and static charge dissipation result.

All the patents and applications referred to herein are hereby specifically, and totally incorporated herein by reference in their entirety in the instant specification.

The following Examples further define and describe embodiments herein. Unless otherwise indicated, all parts and percentages are by weight.

EXAMPLES

Control Example 1

Preparation of Image Member Web Stock

A flexible electrophotographic imaging member web stock, structurally similar to that shown in FIG. 2, was prepared by providing a 0.01 micrometer thick titanium layer 2 sputtering coated on a flexible biaxially oriented Polyester substrate support 1, having a thermal contraction coefficient of 1.8×10–5/° C., a glass transition temperature Tg of 130° C., and a thickness of 3 mils or 76.2 micrometers (MELINEX 442, available from ICI Americas, Inc.). The titanium coated substrate support layer was applied thereto, by a gravure coating process, a solution containing 10 grams gamma aminopropyltriethoxy silane, 10.1 grams distilled water, 3 grams acetic acid, 684.8 grams of 200 proof denatured alcohol, and 200 grams heptane. This layer was then dried at 125° C. in a forced air oven. The resulting hole blocking layer 3 had an average dry thickness of 0.05 micrometer measured with an ellipsometer.

An adhesive interface layer 4 was then extrusion coated by applying to the hole blocking layer, a wet coating containing 5 percent by weight based on the total weight of the solution of polyester adhesive (MOR-ESTER 49,000, available from Morton International, Inc.) in a 70:30 volume ratio mixture of tetrahydrofuran/cyclohexanone. The resulting adhesive interface layer 4, after passing through an oven, had a dry thickness of 0.095 micrometer.

The adhesive interface layer 4 was thereafter coated, by extrusion, with a photogenerating layer 5 containing 7.5 percent by volume trigonal selenium (Se), 25 percent by volume N,N'-diphenyl-N,N'-bis(3-methylphenyl)-1,1'-biphenyl-4,4'-diamine, and 67.5 percent by volume polyvinylcarbazole. This photogenerating layer 5 was prepared by introducing 8 grams polyvinyl carbazole and 140 milliliters of a 1:1 volume ratio of a mixture of tetrahydrofuran and toluene into a 20 ounce amber bottle. To this solution was added 8 grams of trigonal Se and 1,000 grams of ⅛ inch (3.2 millimeter) diameter stainless steel shot. This mixture was then placed on a ball mill for 72 to 96 hours. Subsequently, 50 grams of polyvinyl carbazole and 2.0 grams of N,N'-diphenyl-N,N'-bis(3-methylphenyl)-1,1'-biphenyl-4,4'-diamine was dissolved in 75 milliliters of 1:1 volume ratio of tetrahydrofuran/toluene. This slurry was then placed on a shaker for 10 minutes. The resulting slurry was thereafter extrusion coated onto the adhesive interface layer 4 to form a coating layer having a wet thickness of 0.5 mil (12.7 micrometers). However, a strip about 10 millimeters wide along one edge of the substrate bearing the blocking layer 3 and the adhesive layer 4 was deliberately left uncoated by any of the photogenerating layer material to facilitate adequate electrical contact by a ground strip layer that was applied later. This photogenerating layer was dried at 125° C. to form a dry photogenerating layer 38 having a thickness of 2.0 micrometers.

This coated imaging member web was simultaneously extrusion overcoated with a charge transport layer 6 and a ground strip layer (same as 86 or 87 shown in FIG. 3) using a 3 mil gap Bird applicator. The charge transport layer was prepared by introducing into an amber glass bottle a weight ratio of 1:1 N,N'-diphenyl-N,N'-bis(3-methylphenyl)-1,1'-biphenyl-4,4'-diamine and Makrolon 5705, a bisphenol A polycarbonate resin having a molecular weight of about 120,000 commercially available from Farbensabricken Bayer A. G. The resulting mixture was dissolved to give a 15 percent by weight solids in 85 percent by weight methylene chloride. This solution was applied over the photogenerator layer 5 to form a coating which, upon drying, gave a charge transport layer 6 thickness of 24 micrometers and a thermal contraction coefficient of 6.5×10–5/° C.

The approximately 10-millimeter wide strip of the adhesive layer left uncoated by the photogenerator layer was coated with a ground strip layer during a co-coating process. This ground strip layer, after drying at 125° C. in an oven, had a dried thickness of about 14 micrometers. This ground strip (after converted into a seamed imaging member belt) providing electrical continuity with the conductive layer 2 was electrically grounded, by conventional means such as a carbon brush contact means during conventional imaging member belt xerographic imaging process.

The electrophotographic imaging member web stock, at this point if unrestrained would spontaneously curl upwardly into a 1½ inch diameter tube. Therefore, the application of an anti-curl back coating was required to provide the desired imaging member web flatness. Application of anti-curl back coating was carried out by solution extrusion coating technique using a solution prepared to comprise 9 percent by weight solid (consisting of a polymer binder and an adhesion promoter) dissolved in 91 percent by weight methylene chloride. A resulting dried 13 micrometer thick typical prior art anti-curl back coating, which included 92 percent by weight MAKROLON 5705 (a bisphenol A polycarbonate resin poly(4,4'-isopropylidene-diphenylene carbonate and same material as that used in the charge transport layer 6) and 8 percent by weight VITEL PE-200 polyester adhesion promoter (available from Goodyear Rubber and Tire Company), was formed on the back side of the MELINEX 442 support substrate 1. This anti-curl backing layer was positioned on the substrate to render the imaging member with proper flatness. The fabricated electrophotographic imaging member web was used to serve as control.

Example 2

Preparation of Anti-Curl Backing Layer with Ligno-PANi Fillers

Seven flexible electrophotographic imaging member web stocks were prepared according to the procedures and using the same materials as those described in the Control Example 1, with the exception that the anti-curl back coating used to render the desired imaging member web flatness was replaced with an improved formulation of anti-curl back coating 72.

Seven anti-curl back coating solutions were prepared to have the same compositions as that of the Control Example 1, except that each coating solution was prepared by: (1) dissolving adhesion promoter VITEL PE-200 in methylene chloride to give a 7 weight percent PE-200 solution, (2) dispersing a pre-determined amount of Ligno-PANi (available from Seepott, Inc.) into the PE-200 solution through ball-mill processing, and (3) mixing the Ligno-PANi dispersed PE-200 solution into a MAKROLON/methylene chloride solution to form an anti-curl back coating solution. The procedures were repeated to make eight individual solutions, which upon application to the back side of each imaging member substrate 1 and after drying, gave 5, 10, 20, 30, 35, 40, and 45 weight percent Ligno-PANi dispersions in the anti-curl back coating 72.

Example 3

Electrical Conductivity Measurement and Belt Cycling

The Control of Example 1 and the electrophotographic imaging members of Example 2 were measured for anti-curl back coating surface electrical conductivity. The results obtained were present in the surface resistivity (in ohms/sq) and Ligno-PANi loading (percentage) relation plot of FIG. 5. As shown in the graph, Ligno-PANi dispersion, in all these loading levels, was effectual to provide anti-static and static charge dissipation result. When imaging web stocks were converted into ultrasonically welded seamed belts for machine cycling tests, drive torque and belt stall problems seen with the Control imaging belt of Example 1, having standard anti-curl back coatings, were eliminated in all the belts using Ligno-PANi dispersed anti-curl back coating counterparts.

It is also worth mentioning that a 5 weight percent PTFE particle dispersion was seen to be able to produce a 2 times wear resistance improvement for both the control and all the Ligno-PANi anti-curl back coatings when wear tests were carried out through frictional interaction generated by mechanically sliding an anti-curl back coating against a glass tube surface.

While devices have been described in detail with reference to specific and embodiments, it will be appreciated that various modifications and variations will be apparent to the artisan. All such modifications and embodiments as may readily occur to one skilled in the art are intended to be within the scope of the appended claims.

What is claimed is:

1. An electrostatographic imaging member comprising a flexible supporting electrically conductive substrate, an anti-curl backing layer positioned on one side of the substrate, and an imaging layer positioned on the substrate on a side opposite the anti-curl backing layer, wherein the anti-curl backing layer comprises a film forming polymer binder and a lignin sulfonic acid doped polyaniline dispersion wherein said anti-curl backing layer has a surface resistivity of from about $10^6$ to about $10^{14}$ ohms/sq.

2. An electrostatographic imaging member in accordance with claim 1, wherein the lignin sulfonic acid doped polyaniline is present in the anti-curl backing layer in an amount of from about 1 to about 50 percent by weight of total solids.

3. An electrostatographic imaging member in accordance with claim 2, wherein the lignin sulfonic acid doped polyaniline is present in the anti-cud backing layer in an amount of from about 5 to about 20 percent by weight of total solids.

4. An electrostatographic imaging member in accordance with claim 3, wherein the lignin sulfonic acid doped polyaniline is present in the anti-curl backing layer in an amount of from about 6 to about 10 percent by weight of total solids.

5. An electrostatographic imaging member in accordance with claim 1, wherein the film forming polymer binder is a polymer selected from the group consisting of polycarbonates, polystyrenes, polyesters, polyurethanes, polyarylethers, polysulfones, polyarylate, polybutadienes, polyakylenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, vinylchloride and vinyl acetate copolymers, acrylate copolymers, alkyd resins, cellulosic film formers, styrene-butadiene copolymers, vinylidenechloride vinylchloride copolymers, vinylacetate-vinylidenechloride copolymers, styrene-alkyd resins, and mixtures thereof.

6. An electrostatographic imaging member in accordance with claim 5, wherein the binder is a polycarbonate.

7. An electrostatographic imaging member in accordance with claim 6, wherein said polycarbonate is selected from the group consisting of poly(4,4'-isopropylidene-diphenylene carbonate), poly(4,4-diphenyl-1,1'-cyclohexane carbonate), poly(4,4'-isopropylidene-3,3'-dimethyl-diphenyl carbonate), and mixtures thereof.

8. An electrostatographic imaging member in accordance with claim 1, wherein said anti-curl backing layer further comprises an adhesion promoter.

9. An electrostatographic imaging member in accordance with claim 8, wherein said adhesion promotor is a selected from the group consisting of polyethylene terephthalate glycol and a copolyester.

10. An electrostatographic imaging member in accordance with claim 8, wherein said adhesion promotor is present in the anti-curl backing layer in an amount of from about 1 to about 15 percent by weight of the film forming polymer binder.

11. An electrosatographic imaging member in accordance with claim 10, wherein said adhesion promotor is present in the anti-curl backing layer in an amount of from about 6 to about 10 percent by weight of the film forming polymer binder.

12. An electrostatographic imaging member in accordance with claim 1, wherein said anti-curl backing layer further comprises a filler in addition to lignin sulfonic acid doped polyaniline.

13. An etectrostatographic imaging member in accordance with claim 12, wherein said filler is selected from the group consisting of polymers, metal oxides, silicas, silicates, carbons, and mixtures thereof.

14. An electrostatographic imaging member in accordance with claim 13, wherein said filler is selected from the group consisting of polytetrafluoroethylene, polyalkylenes, and mixtures thereof.

15. An electrostatographic imaging member in accordance with claim 1, wherein the anti-curl backing layer has a surface resistivity of from about $10^8$ to about $10^{13}$ ohms/sq.

16. An electrostatographic imaging member in accordance with claim 1, wherein anti-curl backing layer has a thickness ranging from about 5 micrometer to about 60 micrometers.

17. An electrostatographic imaging member in accordance with claim 1, wherein the electrostatographic imaging member is in the form of a flexible belt.

18. An image forming apparatus for forming images on a recording medium comprising:

a photoreceptor having a charge-retentive surface and comprising an electrically conductive substrate, an imaging layer to receive an electrostatic latent image thereon, wherein the imaging layer is positioned on one side of the substrate, and an anti-curl backing layer positioned on the substrate on a side opposite to that of the imaging layer, wherein the anti-curl backing layer comprises a film forming polymer binder and a lignin sulfonic acid doped polyaniline dispersion, wherein said anti-curl backing layer has a surface resistivity of from about $10^6$ to about $10^{14}$ ohms/sg;

a development component to apply toner to the charge-retentive surface to develop the electrostatic latent image to form a developed image on the charge retentive surface;

a transfer member to transfer the developed image from the charge retentive surface to a copy substrate; and a fixing component to fuse the developed image to the copy substrate.

19. An image forming apparatus for forming images on a recording medium comprising:

a photoreceptor having a charge-retentive surface and comprising an electrically conductive substrate, an imaging layer to receive an electrostatic latent image thereon, and an anti-curl backing layer positioned on the substrate on a side opposite to that of the imaging layer, wherein the anti-curl backing layer comprises a film forming polymer binder and a lignin sulfonic acid doped polyaniline dispersion, wherein said anti-curl backing layer has a surface resistivity of from about $10^8$ to about $10^{13}$ ohms/sg;

a development component to apply toner to the charge-retentive surface to develop the electrostatic latent image to form a developed image on the charge retentive surface;

a transfer member to transfer the developed image from the charge retentive surface to a copy substrate; and a fixing component to fuse the developed image to the copy substrate.

* * * * *